US008655243B2

(12) United States Patent
Suzuki

(10) Patent No.: US 8,655,243 B2
(45) Date of Patent: Feb. 18, 2014

(54) IMAGE HEATING APPARATUS HAVING FOUR HELICAL GEARS

(75) Inventor: Kenji Suzuki, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 513 days.

(21) Appl. No.: 12/876,604

(22) Filed: Sep. 7, 2010

(65) Prior Publication Data

US 2011/0058861 A1 Mar. 10, 2011

(30) Foreign Application Priority Data

Sep. 7, 2009 (JP) ..... 2009-205782

(51) Int. Cl.
*G03G 15/20* (2006.01)

(52) U.S. Cl.
USPC ..... 399/328

(58) Field of Classification Search
USPC ..... 399/122, 320, 328, 330
See application file for complete search history.

(56) References Cited

U.S. PATENT DOCUMENTS 5,999,775 A * 12/1999 Kim

FOREIGN PATENT DOCUMENTS

| | | |
|---|---|---|
| JP | 1-55179 | 11/1989 |
| JP | 5-173445 | 7/1993 |
| JP | 2000-194216 | 7/2000 |
| JP | 2007-148336 | 6/2007 |

* cited by examiner

*Primary Examiner* — Walter L Lindsay, Jr.
*Assistant Examiner* — Milton Gonzalez
(74) *Attorney, Agent, or Firm* — Fitzpatrick, Cella, Harper & Scinto

(57) ABSTRACT

An image heating apparatus includes a rotatable heater heating an image on a recording material; a rotatable pressor contacting the heater to form a nip therebetween; a driving source; first and second helical gears rotatable by a driving force supplied from the driving source and having different twisting directions; first and second switching members for switching between rotation transmission and non-transmission from a driving gear to the first and second helical gears, respectively; third and fourth helical gears provided on the heater in meshing engagement with the first and second helical gears, respectively; and a switch for switching at least between drive transmission by first switching member and drive transmission by the second switching member to change a position of the heating rotatable member along a rotational axis direction of the heater.

15 Claims, 8 Drawing Sheets

(a)

(b)

(a)

(b)

(a)

(b)

IMAGE HEATING APPARATUS HAVING FOUR HELICAL GEARS

FIELD OF THE INVENTION AND RELATED ART

The present invention relates to an image heating apparatus mountable in an image forming apparatus, such as an electrophotographic copy machine, an electrophotographic printer, or the like, to heat the image on a recording medium.

As one of the image heating apparatuses mountable in an image forming apparatus, such as an electrophotographic copy machine, an electrophotographic printer, or the like, a fixing apparatus of the heat-roller type has been known. A fixing apparatus of the heat-roller type has: a fixation roller; a heater for heating the fixation roller; a pressure roller which is pressed upon the peripheral surface of the fixation roller to form a nip; etc. A recording medium on which an unfixed toner image is present is heated while being conveyed through the abovementioned nip, remaining pinched by the fixation roller and the pressure roller, whereby the image on the recording medium is thermally fixed to the recording medium. A fixing apparatus of the heat-roller type has also: a thermistor for detecting the temperature of the fixation roller; a parting claw for separating the recording medium from the peripheral surface of the fixation roller after the thermal fixation of the toner image; etc. These components are in contact with the peripheral surface of the fixation roller. Thus, a fixing apparatus of the heat-roller type suffers from the problem that as the fixation roller is rotated, the areas of the peripheral surface of the fixation roller, which are in contact with the abovementioned components, are likely to be scratched and/or frictionally worn, because the thermistor, the parting claw, etc., are in contact with the peripheral surface of the fixation roller as described above. Further, a sheet of a recording medium has a certain amount of burr along its edges. This creates the problem that as multiple sheets of recording media, which are the same in size, are repeatedly and continuously introduced into (and put through) the nip, the portions of the peripheral surface of the fixation roller, which correspond in position to the edges of the sheet of the recording medium, which are parallel to the recording-medium conveyance direction, are likely to be damaged and/or frictionally worn. Japanese Laid-open Patent Application 2000-194216 discloses one of the technologies for solving these problems. According to this technology, the front and rear plates of the fixing apparatus, with which the fixation roller and the pressure roller are rotatably supported are reciprocally moved in the direction perpendicular to the recording-medium conveyance direction by a combination of a motor and a cam, which is dedicated to the reciprocal movement. Further, Japanese Laid-open Patent application 2000-194216 discloses another technology for preventing the occurrence of the above-described problems. According to this technology, one of the fixation roller and the pressure roller is reciprocally moved in the direction perpendicular to the recording-medium conveyance direction. Japanese Laid-open Patent Application H05-173445 discloses another technology for preventing the occurrence of the above-described problems. According to this technology, only the fixation roller is reciprocally moved in the direction perpendicular to the recording-medium conveyance direction by placing a lever, the movement of which is caused by the cam movement, in contact with one of the end surfaces of the fixation roller. Japanese Laid-open Patent Application 2007-148336 discloses yet another technology for preventing the occurrence of the above-described problems.

According to this technology, only the fixation roller is reciprocally moved in the direction perpendicular to the recording-medium conveyance direction by placing a fixation roller, end-pressing member, which is connected to a solenoid switch, in contact with one of the lengthwise end surfaces of the fixation roller, with the use of a solenoid switch which is connected to the fixation-roller, end-pressing member.

The fixing apparatuses described above are complicated in the structure of their mechanism for reciprocally moving the fixation roller in its lengthwise direction while rotating the fixation roller in order to minimize the friction wear of the portions of the peripheral surface of the fixation roller, which are in contact with a thermistor, a parting claw, etc., and also, the frictional wear of the portions of the peripheral surface of the fixation roller, which come into contact with the edges of recording medium, which are parallel to the recording-medium conveyance direction. Therefore, it has been desired to simplify in structure the mechanism of a fixing apparatus, which is for reciprocally moving the fixation roller in its lengthwise direction while rotating the fixation roller. Thus, the primary object of the present invention is to provide an image heating apparatus which is simple in the structural arrangement for reciprocally moving its rotational heating member in the direction perpendicular to the lengthwise direction of the rotational heating member in order to reduce the rotational heating member in the frictional wear of its peripheral surface.

SUMMARY OF THE INVENTION

The primary object of the present invention is to provide an image heating apparatus which is simple in its structural arrangement for reciprocally moving its rotational heating member in the lengthwise direction of the rotational heating member.

According to an aspect of the present invention, there is provided an image heating apparatus comprising a heating rotatable member for heating an image on a recording material, a pressing rotatable member for contacting the heating rotatable member to form a nip therebetween; a driving source; a first helical gear rotatable by a driving force supplied from the driving source; a second helical gear rotatable by a driving force supplied from the driving source, the second helical gear has a twisting direction which is different from that of the first helical gear; a first switching member for switching between rotation transmission and non-transmission from the driving gear to the first helical gear; a second switching member for switching between rotation transmission and non-transmission from the driving gear to said second helical gear; a third helical gear provided on the heating rotatable member in meshing engagement with said first helical gear; a fourth helical gear provided on the heating rotatable member in meshing engagement with the second helical gear; and switching means for switching at least between drive transmission by the first switching member and drive transmission by the second switching member to change a position of the heating rotatable member with respect to a rotational axis direction of the heating rotatable member.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 2(*b*) is a schematic drawing of the fixing apparatus in the first embodiment, as seen from the side from which a sheet of a recording medium is introduced into the fixing apparatus.

FIG. 3(*b*) is a schematic drawing of the fixation-roller reciprocating mechanism of the fixing apparatus in the first embodiment, and depicts the operation of the mechanism, which is for moving the fixation roller from the rear side of the fixing apparatus to the front side.

FIG. 4(*b*) is a schematic drawing for describing the load (thrust) which is generated in the direction parallel to the axial line of the fixation roller by the combination of the helical gears 31 and 33, and the amount of which is proportional to the helix angle of the helical gears.

FIG. 6(*b*) is a block diagram of the hardware for controlling the operation of the fixation roller reciprocation mechanism of the fixing apparatus in the second embodiment of the present invention.

DESCRIPTION OF THE PREFERRED EMBODIMENTS

Embodiment 1

General Structure of Image Forming Apparatus

Figure 1:
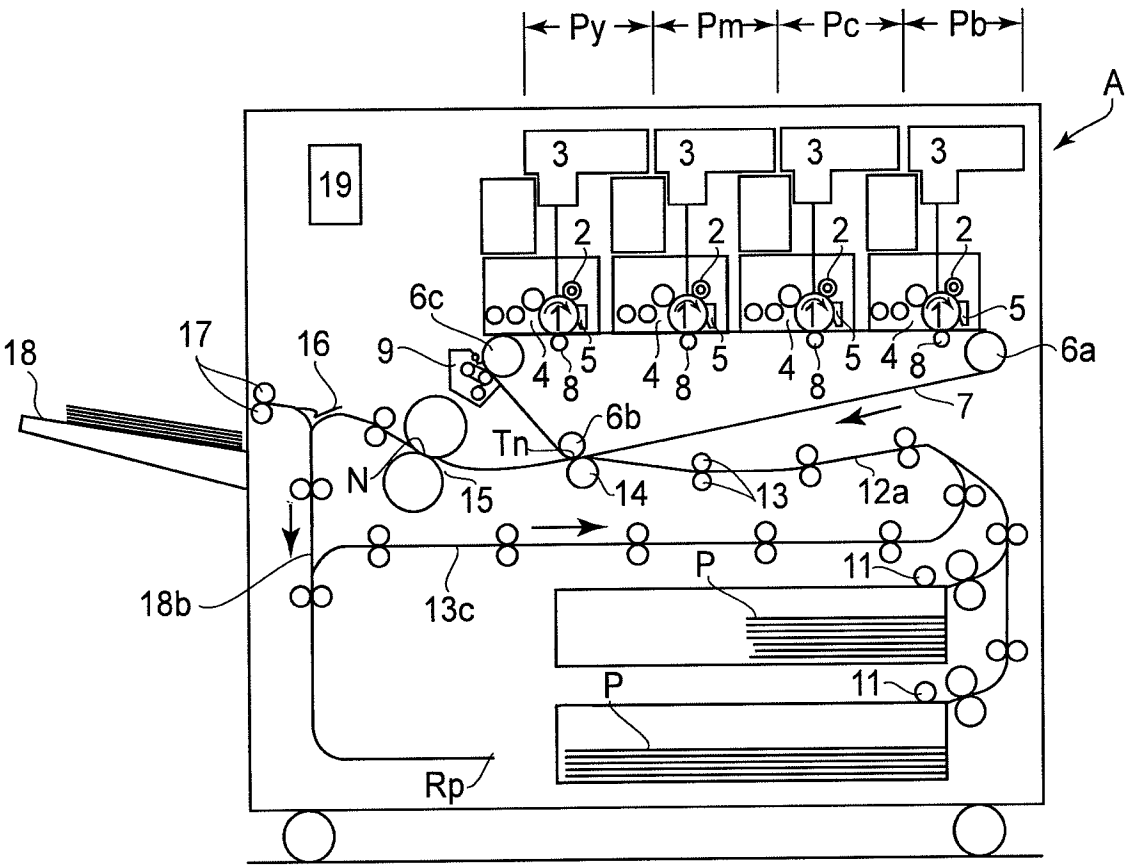
FIG. 1 is a schematic sectional view of a typical image forming apparatus, and shows the structure of the apparatus.

FIG. 1 is a schematic sectional view of a typical image forming apparatus in which an image heating apparatus in accordance with the present invention is mountable as a fixing apparatus (fixing device). It depicts the structure of the image forming apparatus. The image forming apparatus depicted in FIG. 1 is an electrophotographic full-color laser printer. The image forming apparatus A in this embodiment has the first, second, third, and fourth image forming portions Py, Pm, Pc, and Pb, which are in the main assembly of the apparatus and are parallel with each other. The image forming apparatus A forms monochromatic toner images, different in color, by carrying out the processes of charging, exposing, developing, and transferring. Designated by a reference numeral 19 is a control portion as a controlling means, which is made up of a CPU, ROMs, RAM, etc. As a print command signal outputted from an external apparatus (unshown) such as a host computer, is inputted into the control portion 19, the control portion 19 makes the image forming portions Py, Pm, Pc, and Pb sequentially operate, following the image-formation control sequence stored in the memories. In each of the image forming portions Py, Pm, Pc, and Pb, a photosensitive drum 1, which is an image bearing member, is rotated in the direction indicated by an arrow mark at a preset peripheral velocity (process speed). The image forming apparatus A is also provided with an intermediary transfer belt 7, which is supported, and kept stretched, by a driver roller 6*a*, a follower roller 6*b*, and a tension roller 6*c*. The intermediary transfer belt 7 is in contact with the photosensitive drum 1 of each of the image forming portions Py, Pm, Pc, and Pb. The intermediary transfer belt 7 is circularly moved by the driver roller 6*a* in the direction indicated by another arrow mark at a speed which corresponds to the peripheral velocity of each of the photosensitive drums 1. In the image forming portion Py for forming an image of the first color, which is yellow, the peripheral surface of the photosensitive drum 1 is uniformly charged by a charging device 2 to a preset polarity and a preset potential level. Then, an exposing apparatus 3 scans (exposes) the charged portion of the peripheral surface of the photosensitive drum 1 with a beam of laser light while modulating the beam of laser light according to the information of the image to be formed, which is sent from an external apparatus. Thus, an electrostatic latent image which reflects the information of the image to be formed, is effected on the charged portion of the peripheral surface of the photosensitive drum 1. This latent image is developed by a developing apparatus 4 into a visible image formed of yellow toner (developer); a visible image is formed of yellow toner on the peripheral surface of the photosensitive drum 1 (hereafter, visible image formed of toner will be referred to as yellow toner image). The charging, exposing, and developing processes similar to those carried out in the image forming portion Py are carried out in the image forming portions Pm, Pc, and Pb for forming magenta (second color), cyan (third color), and black (fourth "color") images, one for one. The monochromatic toner images, different in color, formed on the photosensitive drums 1 in the image forming portions Py, Pm, Pc, and Pb, one for one, are sequentially transferred in layers onto the outward surface of the intermediary transfer belt 7 by first transfer rollers (transferring members) which oppose the photosensitive drums 1, one for one, with the presence of the intermediary transfer belt 7 between each of the first transfer rollers 8 and the corresponding photosensitive drum 1. Consequently, a full-color toner image is formed on the outward surface of the intermediary transfer belt 7. After the transfer of the toner image from the photosensitive drum 1, the toner remaining on the peripheral surface of the photosensitive drum 1 is removed by a drum cleaner 5, and is used for the following image formation operation. Meanwhile, sheets of a recording medium P are sent one by one by a recording-medium, feeding-and-conveying roller 11 to a pair of registration rollers 13 through a recording-medium conveyance passage 12*a*. Then, each sheet of the recording medium P (which hereafter will be referred to simply as recording medium P) is conveyed by the pair of registration rollers 13 to a second transfer nip Tn, which is between the intermediary transfer belt 7 and a second transfer roller 14, and then, is conveyed through the second transfer nip Tn while remaining pinched by the intermediary transfer belt 7 and the second transfer roller 14. During this conveyance of the recording medium P through the second transfer nip Tn, the full-color toner image (four monochromatic toner images) on the intermediary transfer belt 7 is transferred onto the recording medium P by the second transfer roller 14. After the transfer of the full-color toner image, the toner remaining on the intermediary transfer belt 7 is removed by a belt cleaner 9. Then, the recording medium P on which the unfixed full-color toner image is present, is introduced into the nip of a fixing apparatus 15, with the toner image bearing surface of the recording medium P facing upward. Then, the recording medium P is conveyed through the nip while remaining pinched by the aforementioned fixation roller and pressure roller. During the conveyance of the recording medium P through the nip of the fixing apparatus 15, the full-color toner image on the recording medium P is thermally fixed to the surface of the recording medium P. In an image forming operation in which an image is to be formed on only one surface of the recording medium P, after the recording medium P is discharged from the fixing apparatus 15, it is guided by a recording-medium-passage switching flapper 16 to a pair of discharge roller 17. Then, it is discharged by the discharge rollers 17 into a delivery tray 18, which extends from the side of the image forming apparatus A. In an image forming operation in which an image is to be formed on both surfaces of the recording medium P, after the recording medium P is discharged from the fixing apparatus 15, it is guided by the recording-medium-passage switching flapper 16 into a recording-medium turning passage 18*b*, which is below the passage 13*c*. In the recording-medium turning passage 18*b*, as soon as the trailing edge of the recording medium P reaches a turning point Rp, it is reversed in direction, and guided into a two-sided printing passage 13*c*, being positioned so that its surface having no image faces upward. Then, the recording medium P is sent to the pair of registration rollers 13 through the recording-medium conveyance passage 12*a* from the two-sided printing passage 13*c*. Then, the recording medium P is sent by the pair of registration rollers 13 to the second transfer nip Tn. Then, it is conveyed through the second transfer nip Tn while remaining pinched by the second transfer roller 14 and the intermediary transfer belt 7. During this conveyance of the recording medium P through the second transfer nip Nn, the full-color image (four monochromatic toner images) on the intermediary transfer belt 7 is transferred onto the recording medium P. Then, the recording medium P on which the unfixed full-color toner image is present is introduced into the nip of the fixing apparatus 15, with the unfixed toner-image bearing surface of the recording medium P facing upward. Then, the recording medium P is conveyed through the nip while remaining pinched by the aforementioned fixation roller and the pressure roller. During the conveyance of the recording medium P through the nip of the fixing apparatus 15, the unfixed full-color toner image on the recording medium P is thermally fixed to the surface of the recording medium P. Then, the recording medium P is discharged from the fixing apparatus 15. Then, it is guided by a recording-medium-passage switching flapper 16 to a pair of discharge roller 17. Then, it is discharged by the discharge rollers 17 into the delivery tray 18.

(Structure of Fixing Apparatus)

Figure 2:
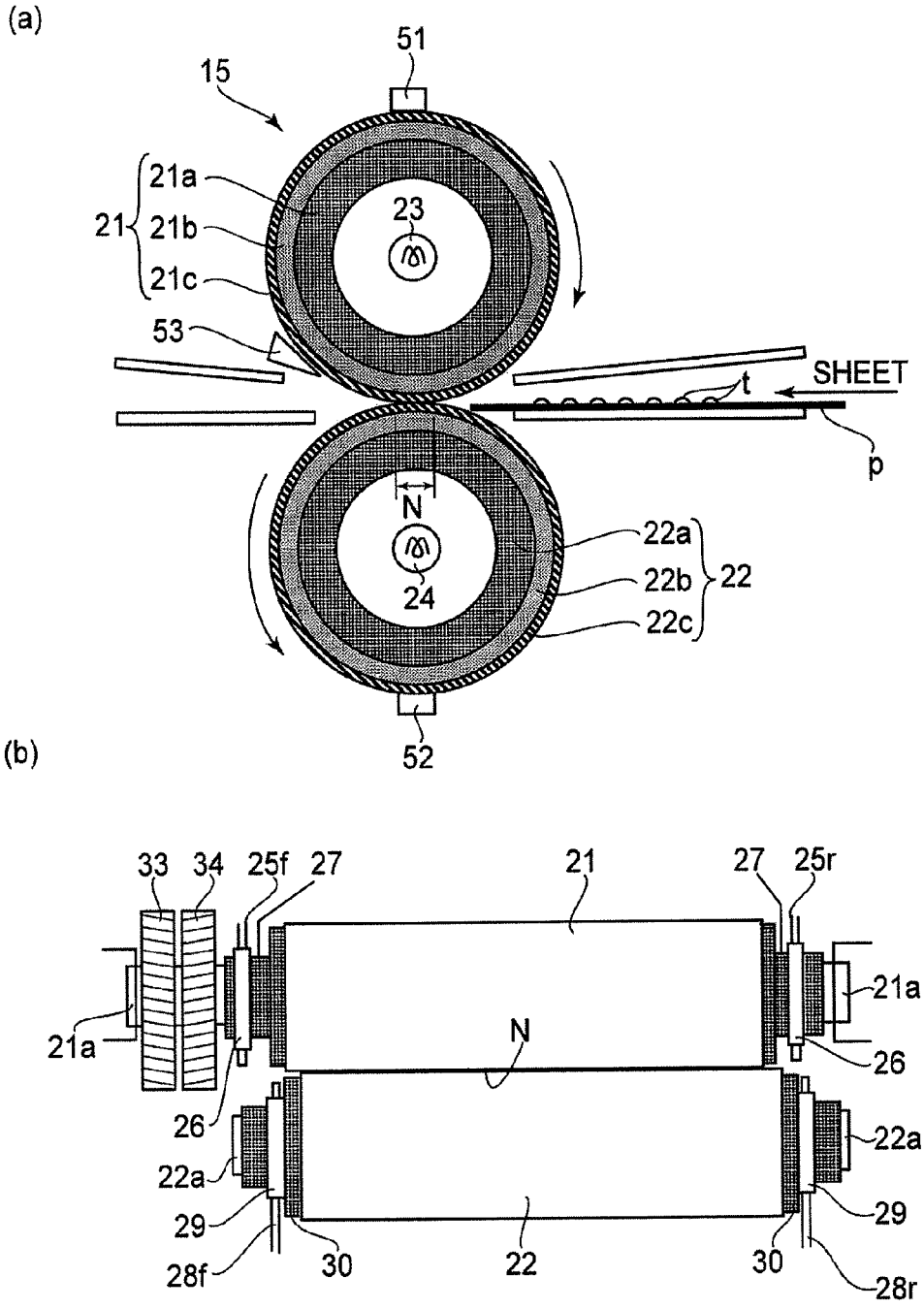
FIG. 2(*a*) is a schematic sectional view of the fixing apparatus in the first preferred embodiment of the present invention, and shows the structure of the apparatus.

In the following description of the image heating apparatus as a fixing apparatus and its structural members, the "lengthwise direction" means the direction perpendicular to the recording-medium conveyance direction, whereas the "widthwise direction" means the direction parallel to the recording-medium conveyance direction. The "length" of a given member means the measurement of the member in the "lengthwise direction", whereas the "width" of a given member means the measurement of the member in the "widthwise direction". The widthwise direction of the recording medium means the direction perpendicular to the recording-medium conveyance direction on the surface of the recording medium. The lengthwise direction of the recording medium means the direction parallel to the recording-medium conveyance direction on the surface of the recording medium. The width of the recording medium means the measurement of the recording medium in terms of the widthwise direction of the recording medium. The length of recording medium means the measurement of the recording medium in terms of the lengthwise direction of the recording medium. FIG. 2(*a*) is a schematic sectional view of the fixing apparatus in this embodiment, at a plane perpendicular to the lengthwise direction, and shows the general structure of the apparatus, and FIG. 2(*b*) is a schematic drawing of the fixing apparatus in this embodiment, as seen from the recording-medium entrance side of the fixing apparatus, and shows the structure of the apparatus. The fixing apparatus 15 in this embodiment is of the heat-roller type. It has a fixation roller 21, a pressure roller 22, etc. The fixation roller 21 is a rotatable heating member, and is cylindrical. The pressure roller 22 is a pressure applying member, which also is cylindrical and rotatable. There are halogen heaters 23 and 24, which are heating members, in the hollow of the fixation roller 21 and the hollow of the pressure roller 22, respectively. The fixation roller 21, the pressure roller 22, and the halogen heaters 23 and 24 are greater in measurement in terms of the lengthwise direction than the long edges of the longest recording medium P usable with the image forming apparatus A. Referring to FIGS. 2(*a*) and 2(*b*), the fixation roller 21 is made up of a metallic core 21*a*, an elastic layer 21*b*, and a parting layer 21*c*. The metallic core 21*a* is cylindrical and is formed of aluminum, iron, or the like. The elastic layer 21*b* is wrapped around the peripheral surface of the metallic core 21*a*, except for the lengthwise end portions of the metallic core 21*a*. The parting layer 21*c* covers the entirety of the outward surface of the elastic layer 21*b*. The material for the elastic layer 21*b* is a foamed substance such as foamed silicon rubber. The material for the parting layer 21*c* is a fluorinated resin, for example, PFA (copolymer of tetrafluoroethyline and perfluoroalkylvinyl) or PTFE (polytetra perfluoroethylene). The parting layer 21*c* is formed by coating the outward surface of the elastic layer 21*b* with one of the above-mentioned fluorinated resins, or covering the elastic layer 21*b* with a piece of tube made of fluorinated resin. The fixation roller 21 is supported by the first (left side in FIG. 3) and second (right side in FIG. 3) frames 25*f* and 25*r*, respectively, of the fixing apparatus 15 in such a manner that not only is the fixation roller 21 rotatable, but also, it can be moved in the lengthwise direction. More specifically, the fixation roller 21 is provided with a pair of cylindrical adiabatic bushings 27 and 27, which are solidly fitted around the lengthwise end portions of metallic core 21*a*. Further, the first and second frames 25*f* and 25*r* are fitted with a pair of bearings 26 and 26, one for one, by which the bushings 27 and 27 are supported at the front and rear ends, respectively. The fixing apparatus 15 is structured so that a preset amount of gap, in terms of the lengthwise direction, is provided between the large diameter portion of the bushing 27 and corresponding bearing 26, to allow the fixation roller 21 to be moved in the lengthwise direction. That is, the pair of adiabatic bushings 27 and 27 are supported by the pair of bearings 26 and 26, one for one, so that the adiabatic bushings 27 and 27 are allowed to rotate about their axial lines. The halogen heater 23 is in the hollow of the metallic core 21*a* of the fixation roller 21, being supported at its metallic connectors which make up the lengthwise end portions of the heater 23, by a pair of lamp supporting members (unshown) which are at the lengthwise ends, one for one, of the hollow of the metallic core 21*a*. Like the fixation roller 21, the pressure roller 22 is made up of a metallic core 22*a*, an elastic layer 22*b*, and a parting layer 22*c*. The metallic core 22*a* is cylindrical and is formed of aluminum, iron, or the like. The elastic layer 22*b* is wrapped around the peripheral surface of the metallic core 22*a*, except for the lengthwise end portions of the metallic core 22*a*. The parting layer 22*c* covers the entirety of the outward surface of the elastic layer 22*b*. The material for the elastic layer 22*b* is the same as that of the elastic layer 21*b* of the fixation roller 21, and the material for the parting layer 22*c* is the same as that for the parting layer 21*c* of the fixation roller 21. The pressure roller 22 is on the bottom side of the fixation roller 21, and is parallel to the fixation roller 21. The pressure roller 22 is rotatably supported by a pair of bottom frames 28*f* and 28*r*, which are at the front and rear end portions, respectively, of the fixing apparatus 15. More specifically, the pressure roller 22 is provided with a pair of cylindrical adiabatic bushings 30 and 30, which are solidly fitted around the lengthwise end portions of metallic core 22*a*. Further, the pair of bottom frames 28*f* and 28*r* are fitted with a pair of bearings 29 and 29, one for one, by which the bushings 30 and 30 are supported at the front and rear ends, respectively. The fixing apparatus 15 is structured so that virtually no gap, in terms of the lengthwise direction, is provided between the large diameter portion of the bushing 30 and corresponding bearing 29, so that the pressure roller 22 cannot be moved in the lengthwise direction. That is, the pair of adiabatic bushings 30 and 30 are supported by the pair of bearings 29 and 29 so that the diabetic bushings 30 and 30 are allowed to rotate about their axial lines. The halogen heater 24 is in the hollow of the metallic core 22*a* of the pressure roller 22, being supported at its metallic connectors which make up the lengthwise end portions of the halogen heater 24, by a pair of lamp supporting members (unshown) which are at the lengthwise ends, one for one, of the hollow of the metallic core 22*a*. The bearings 29 and 29 of the pressure roller 22 are kept pressured toward the fixation roller 21 by a pair of compression springs (unshown) which are between the bearings 29, and the bottom frames 28*f* and 28*r*, one for one. Thus, the peripheral surface of the pressure roller 22 is kept pressed upon the peripheral surface of the fixation roller 21 by these springs, so that a preset amount of pressure is provided between the peripheral surface of the fixation roller 21 and peripheral surface of the pressure roller 22 to keep the elastic layer 22*b* of the pressure roller 22 and elastic layer 21*b* of the fixation roller 21 elastically deformed, creating thereby a nip N having a preset width, between the peripheral surface of the pressure roller 22 and the peripheral surface of the fixation roller 21. The fixing apparatus 15 is provided with a thermistor 51 and a parting claw 53, which are a temperature detecting means and a recording medium separating member, respectively. The thermistor 51 and parting claw 53 are in contact with the peripheral surface of the fixation roller 21. The fixing apparatus 15 is also provided with a thermistor 52, which is also a temperature detecting means. It is in contact with the peripheral surface of the pressure roller 22. The thermistor 51 is for detecting the surface temperature of the fixation roller 21, and the thermistor 52 is for detecting the surface temperature of the pressure roller 22. The parting claw 53 is for separating the recording medium P from the peripheral surface of the fixation roller 21 after the thermal fixation of the toner image(s).

(Structure of Fixation Roller Reciprocation Mechanism)

Figure 3:
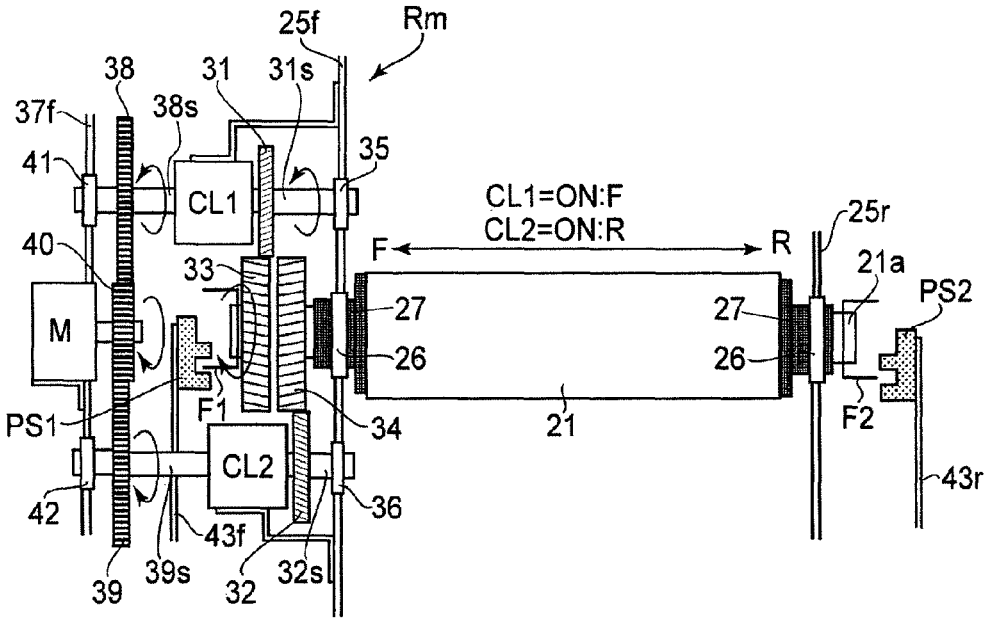
FIG. 3(*a*) is a schematic drawing of the fixation roller reciprocating mechanism of the fixing apparatus in the first embodiment, and depicts the operation of the mechanism, which is for moving the fixation roller from the front side of the fixing apparatus to the rear side.
Figure 3:
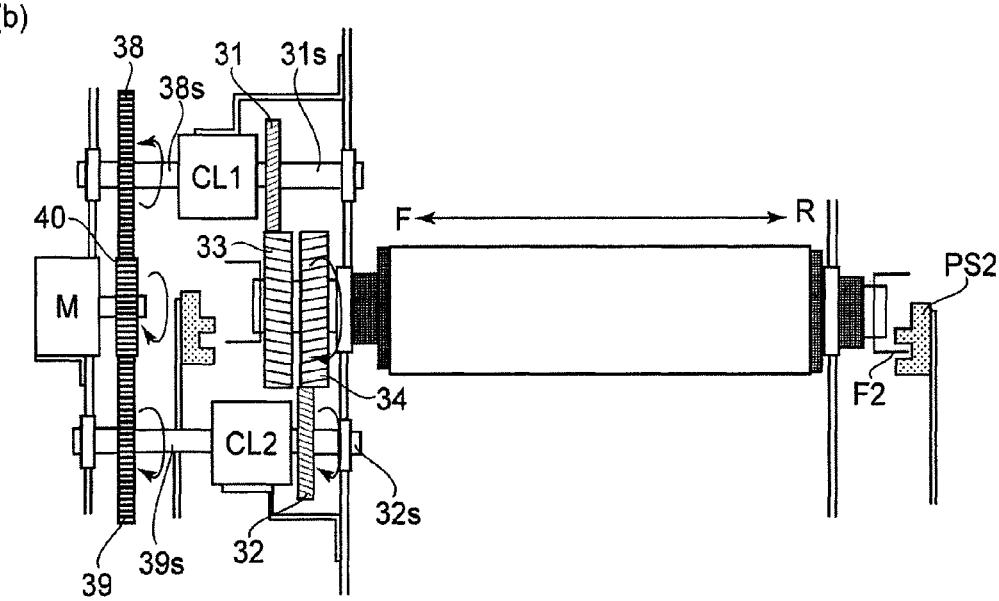

FIG. 3 is a schematic drawing of a fixation roller reciprocating mechanism of the fixing apparatus in this embodiment. FIG. 3(*a*) is a schematic drawing of the fixation-roller reciprocating mechanism (which hereafter will be referred to simply as the reciprocation mechanism), and depicts the operation of the mechanism, which is for moving the fixation roller 21 from the front side of the fixing apparatus 15 to the rear side. FIG. 3(*b*) is a schematic drawing of the fixation-roller reciprocating mechanism of the fixing apparatus in the first embodiment, and depicts the operation of the mechanism, which is for moving the fixation roller 21 from the rear side of the fixing apparatus 15 to the front side. The reciprocation mechanism Rm is structured not only to rotate the fixation roller 21, but also to reciprocally moving the fixation roller 21 in the lengthwise direction. The metallic core 21*a* of the fixation roller 21 is solidly fitted with the third and fourth helical gears 33 and 34, respectively. The third and fourth helical gears 33 and 34 are on one of the lengthwise end portions of the metallic core 21*a*, more specifically, the lengthwise end portion of the metallic core 21*a*, which is on the front side of the first frame 25*f*. The two helical gears 33 and 34 are the same in tooth count and pitch, but, are different in the helix direction. The first and second helical gears 31 and 32, which mesh with the third and fourth helical gears 33 and 34, respectively, are supported by the first frame 25*f*, which is the front frame. The first helical gear 31 is solidly attached to a gear shaft 31*s*, which is rotatably supported by the first frame 25*f*, with the presence of a bearing 35 between the first frame 25*f* and gear shaft 31*s*. The second helical gear 32 is solidly attached to a gear shaft 32*s*, which is rotatably supported by the first frame 25*f*, with the placement of a bearing 36 between the first frame 25*f* and gear shaft 32*s*. The first and second helical gears 31 and 32 are the same in tooth count and pitch circle, but are different in the helix direction. The reciprocation mechanism Rm is provided with a motor M as a mechanical power source, and a first spur gear 38 as a first driving force transmitting gear, and a second spur gear 39 as the driving force transmitting second member. The motor M, the first spur gear 38, and the second spur gear 39 are attached to the second top frame 37*f*, which is on the outward side of the first top frame 25*f* in terms of the lengthwise direction of the fixing apparatus 15.

The motor M attached to the second top frame 37*f* is solidly fitted with a spur gear 40 as a primary driver gear. The first spur gear 38 is solidly attached to a gear shaft 38*s*, which is rotatably supported by the second top frame 37*f* with the placement of a bearing 41 between the gear shaft 38*s* and second top frame 37*f*. The first spur gear 38 meshes with the spur gear 40. The second spur gear 39 is solidly attached to a gear shaft 39*s*, which is rotatably supported by the second top frame 37*f*, with the placement of a bearing 42 between the first top frame 37*f* and gear shaft 39*s*. The second spur gear 39 also meshes with the spur gear 40. The first and second spur gears 38 and 39 are the same in tooth count and pitch circle. The free end of the gear shaft 38*s* of the first spur gear 38, and the free end of the gear shaft 31*s* of the first helical gear 31, are connected to the first electromagnetic clutch CL1 as a first switching member. The first electromagnetic clutch CL1 is structured to electromagnetically connect or disconnect the gear shaft 38*s* of the first spur gear 38 and the gear shaft 31*s* of the first helical gear 31, with the use of a clutch plate, and the like. When the first electromagnetic clutch CL1 is on standby, the gear shaft 38*s* of the first spur gear 38 and the gear shaft 31*s* of the first helical gear 31, are kept separated from each other. The free end of the gear shaft 39*s* of the second spur gear 39, and the free end of the gear shaft 32*s* of the second helical gear 32, are connected to the second electromagnetic clutch CL2 as the second switching member. The second electromagnetic clutch CL2 is structured to electromagnetically connect or disconnect the gear shaft 39*s* of the second spur gear 39 and the gear shaft 32*s* of the second helical gear 32, with the use of a clutch plate, and the like. The second electromagnetic clutch CL2 is virtually the same as the first electromagnetic clutch CL2. When the second electromagnetic clutch CL2 is on standby, the gear shaft 39*s* of the second spur gear 39 and the gear shaft 32*s* of the second helical gear 32 are kept separated from each other. The lengthwise end of the metallic core 21*a* of the fixation roller 21, which is on the second top front frame side, is provided with a flag F1, whereas the lengthwise end of the metallic core 21*a* of the fixation roller 21, which is on the second top rear frame side is provided with a flag F2. A sensor bracket 43*f*, which is between the first top frame 25*f* and the second top frame 37*f*, is provided with a photosensor PS1 as the first detecting member.

As the photosensor PS1 detects the flag F1, it outputs a flag detection signal. A sensor bracket 43*r* which is on the outward side of the first top frame 25*r* is provided with a photosensor PS2 as the second detecting member. As the photosensor PS2 detects the flag F2, it outputs a flag detection signal. As for the positional relationship between the photosensors PS1 and PS2, the two photosensors PS1 and PS2 are positioned so that when one of them can detect the corresponding flag, the other one cannot detect the corresponding flag.

(Fixing Operation of Thermal Fixing Apparatus)

As soon as a print command is inputted into the control portion 19, the control portion 19 begins to control the fixing apparatus 15. First, it controls a temperature control circuit (unshown), following the temperature control sequence stored in the memory, to turn on an electric power source to supply the halogen heaters 23 and 24 with electric power to cause them to generate heat. As the halogen heater 23 generates heat, the metallic core 21*a*, the elastic layer 21*b*, and the parting layer 21*c* of the fixation roller 21 are heated, causing thereby the peripheral surface of the fixation roller 21 to increase in temperature. As the halogen heater 24 generates heat, the metallic core 22*a*, the elastic layer 22*b*, and the parting layer 22*c* of the pressure roller 22 are heated, causing thereby the peripheral surface of the pressure roller 22 to increase in temperature. The surface temperature of the fixation roller 21 is detected by the thermistor 51. The output signal (temperature signal) from the thermistor 51 is taken in by the control portion 19.

Figure 4:
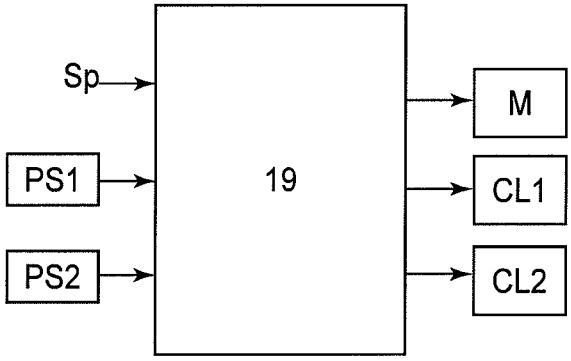
FIG. 4(*a*) is a block diagram of the hardware for controlling the operation of the fixation-roller reciprocation mechanism in the first embodiment.
Figure 4:
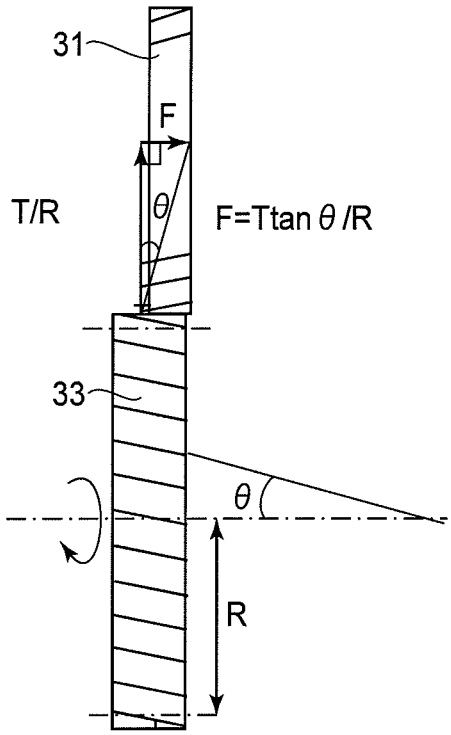
Figure 5:
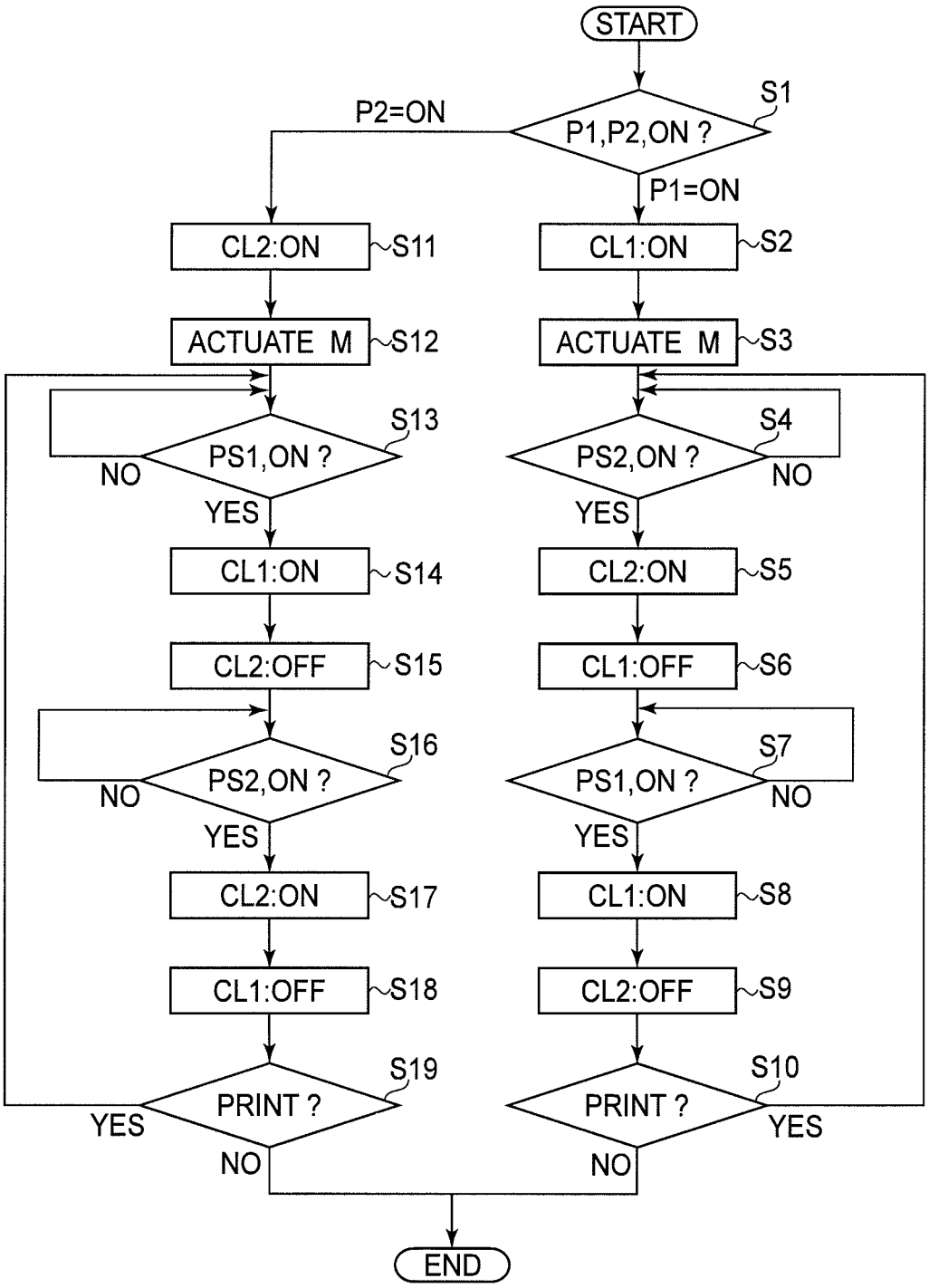
FIG. 5 is a flowchart of an example sequence for controlling the fixation-roller reciprocation mechanism of the fixing apparatus in the first embodiment.

It is based on this output signal from the thermistor 51 that the control portion 19 controls the temperature control circuit to keep the surface temperature of the fixation roller 21 at a preset level (target level). The surface temperature of the pressure roller 22 is detected by the thermistor 52. The output signal (temperature signal) from the thermistor 52 is taken in by the control portion 19. It is based on this output signal from the thermistor 52 that the control portion 19 controls the temperature control circuit to keep the surface temperature of the pressure roller 22 at a preset level (target level). Further, as soon as the control portion 19 receives a print command Sp (FIG. 4(*a*)), it begins to carry out the reciprocation-mechanism control sequence stored in the memory. FIG. 4(*a*) is a block diagram of the hardware of the reciprocation mechanism, and FIG. 4(*b*) is a schematic drawing of the first and third helical gears 31 and 33, and is for describing the load (thrust) generated in the direction parallel to the axial line of the fixation roller 21 as the first helical gear 31 is rotated. The amount of the load is proportional to the helix angle of the first and third helical gears 31 and 33. FIG. 5 is a flowchart of an example of the reciprocation mechanism control sequence.

Referring to FIG. 5, in Step S1, it is determined whether or not the photosensor PS1 has detected the flag F1 (whether PS1 is on or not), and whether or not the photosensor PS2 has detected the flag F2 (whether PS2 is on or not). If the control portion 19 receives the detection signal from the photosensor PS1, it proceeds to Step S2, whereas if it receives the detection signal from the photosensor PS2, it proceeds to Step S11.

(When Photosensor PS1 is On)

In Step S2, the control portion 19 supplies the first electromagnetic clutch CL1 with electric power to engage the first electromagnetic clutch CL1 to connect the gear shaft 38*s* of the first spur gear 38 with the gear shaft 31*s* of the first helical gear 31. That is, in Step S2, the first electromagnetic clutch CL1 is switched in state from the state in which the rotational force cannot be transmitted, to the state in which the rotational force can be transmitted. In Step S3, the motor M is turned on to rotate the gear 40 in the direction indicated by an arrow mark. Thus, the first and second spur gears 38 and 39 are rotated in the directions indicated by corresponding arrow marks by the rotation of the gear 40. The gear shaft 39*s* of the second spur gear 39 and the gear shaft 32*s* of the second helical gear 32, are kept separated by the second electromagnetic clutch CL2. Therefore, the rotation of the second helical gear 32 is not transmitted to the fourth helical gear 34. On the other hand, the gear shaft 38*s* of the first spur gear 38 and the gear shaft 31*s* of the first helical gear 31 are connected with each other through the first electromagnetic clutch CL1. Thus, the rotation of the first spur gear 38 is transmitted to the first helical gear 31 through the first electromagnetic clutch CL1. Therefore, the first helical gear 31 rotates in the direction indicated by an arrow mark in response to the rotation of the gear 40. That is, the first electromagnetic clutch CL1 transmits the rotation of the gear 40 to the first helical gear 31. The first helical gear 31 rotates the third helical gear 33, along with the fixation roller 21, in the direction indicated by an arrow mark (FIG. 2(*a*)). The rotation of the fixation roller 21 is transmitted to the peripheral surface of the pressure roller 22 through the nip N, whereby the pressure roller 22 is rotated in the direction indicated by an arrow mark (FIG. 2(*a*)) by the rotation of the fixation roller 21. As the first helical gear 31 is rotated, it moves the third helical gear 33, along with the fixation roller 21, rearward in the direction parallel to the axial line of the fixation roller 21, by the load (thrust) which is generated in the direction parallel to the axial line of the fixation roller 21, in coordination with the third helical gear 33, and the amount of which is related to the helix angle of the two helical gears 31 and 33. That is, as the first helical gear 31 is rotated, it moves the third helical gear 33, along with the fixation roller 21, from one lengthwise end (front side) of the fixing apparatus 15 to the other lengthwise end (rear side), by the above-described thrust F. Referring to FIG. 4(*b*), it is assumed that the torque of the fixation roller 21 is T; the radius of the pitch circle of the third helical gear 33 is R; and the helix angle of the third helical gear 33 is O.

The amount of the force F, which moves the third helical gear 33 in the direction parallel to the axial line of the gear shaft 31*s* as the first helical gear 31 is rotated can be obtained by the following equation:

$$F=T\times\tan\theta/R.$$

With this thrust F, the first helical gear 31 moves the third helical gear 33, along with the fixation roller 21, from the front side of the fixing apparatus 15 to the rear side in the lengthwise direction. The greater the helix angle θ, the greater the thrust F, and therefore, the faster the speed with which the fixation roller 21 is moved in the lengthwise direction. The speed with which the fixation roller 21 is moved in the lengthwise direction should be set according to the structure of the fixing apparatus 15. However, in consideration of the fact that the fixation roller 21 is moved in the lengthwise direction while an image forming operation is going on, it is desired that the speed with which the fixation roller 21 is moved in the lengthwise direction is set to be no more than roughly 0.5 mm/sec. If the speed with which the fixation roller 21 is moved in the lengthwise direction is set to faster than the abovementioned one, it is possible that the recording medium P will be wrinkled, and/or the monochromatic images will become misaligned, in the nip N, although it depends on the recording-medium type and/or image type. This wrinkling and/or image misalignment did not occur when the speed with which the fixation roller 21 is moved in the lengthwise direction was set to no more than roughly 0.5 mm/sec. In this embodiment, the first helical gear 31 to the fourth helical gear 34 form a 10° helix angle, for example. The external diameter of the fixation roller 21 was 50 mm, the roller 21 rotates at 191 rpm, and moves roughly 0.25 mm/sec in the speed with which it is moved in the lengthwise direction. The helix angle for the helical gears are desired to be in a range of 5-20°, although it depends on the structure of a fixing apparatus. With the above-described structural arrangement, even when the fixation roller 21 was moved in the lengthwise direction while the recording medium P was introduced into (moved through) the nip N, the recording medium P was not subjected to any kind of stress in the nip N; neither was the recording medium P wrinkled, nor did the monochromatic images become misaligned. Incidentally, the above-mentioned figures for the external diameter and speed of revolution of the fixation roller 21 are nothing but examples, and not intended to limit the present invention in scope. In Step S4, it is determined whether or not the photosensor PS2 is on. If the photosensor PS2 detects the flag F2 (FIG. 3(*b*)), and the control portion 19 receives the flag detection signal from the photosensor PS2, the control portion 19 determines that the photosensor PS2 is on (YES), and proceeds to Step S5. In Step S5, the control portion 19 turns on the second electromagnetic clutch CL2 by supplying the second electromagnetic clutch CL2 with electric power. Consequently, the gear shaft 39*s* of the second spur gear 39 and the gear shaft 32*s* of the second helical gear 32, which were kept separated from each other, are electromagnetically connected to each other through the second electromagnetic clutch CL2. In other words, in Step S5, the second electromagnetic clutch CL2 is switched in state from the OFF-state into ON-state. Thus, the rotation of the second spur gear 39 is transmitted to the second helical gear 32, whereby the second helical gear 32 is rotated by the rotation of the gear 40 in the direction indicated by an arrow mark. That is, the second electromagnetic clutch CL2 transmits the rotation of the gear 40 to the second helical gear 32. Then, the second helical gear 32 rotates the fourth helical gear 34 and the fixation roller 21 in the direction indicated by an arrow mark (FIG. 2(*a*)). As the second helical gear 32 rotates, not only does it rotate the fourth helical gear 34 and the fixation roller 21, but also, moves them frontward in the direction parallel to the axial line of the fixation roller 21 by the load F (thrust) (FIG. 4(*b*)) which it generates in coordination with the fourth helical gear 34, and the amount of which is proportional to the helix angle of the two helical gears 32 and 34. That is, as the second helical gear 32 is rotated, it moves the fourth helical gear 34 and the fixation roller 21 from the rear side of the fixing apparatus 15 to the front side in the lengthwise direction, with the abovementioned thrust F. In Step S6, the control portion 19 turns off the first electromagnetic clutch CL1 by stopping the supply of the first electromagnetic clutch CL1 with electric power, whereby the first electromagnetic clutch CL1 is switched in state from the state in which it keeps electromagnetically connected the gear shaft 38*s* of the first spur gear 38 and the gear shaft 31*s* of the first helical gear 31, to the state in which it keeps the gear shaft 38*s* electromagnetically separated from the gear shaft 31*s*. That is, in Step S6, the first electromagnetic clutch CL1 is switched in state from the state in which it transmits the rotational force to the state in which it does not transmit the rotational force, while the second electromagnetic clutch CL2 is on. The timing with which the first electromagnetic clutch CL1 is to be turned off is set in consideration of the length of time necessary to connect the gear shaft 39*s* of the second spur gear 39 with the gear shaft 32*s* of the second helical gear 32. Therefore, it will be such a timing that there will be a sufficient amount of time (several tens of seconds) for fully connecting the gear shaft 39*s* of the second spur gear 39 with the gear shaft 32*s* of the second helical gear 32 in Step S5. Further, the first electromagnetic clutch CL1 is turned off while the second electromagnetic clutch CL2 is on. Therefore, even if the first electromagnetic clutch CL1 is turned off, it is ensured that the fixation roller 21 is rotated by the rotation of gear 40 which is transmitted to the fourth helical gear 34 through the rotational force transmission passage which does not include the first electromagnetic clutch CL1, and therefore, the fixation roller 21 does not change in rotational speed. In Step S7, it is determined whether or not the photosensor PS1 is on. If the photosensor PS1 detects the flag F1 (FIG. 3(*a*)), and the control portion 19 receives the flag detection signal from the photosensor PS1, the control portion 19 determines that the photosensor PS1 is on (Yes), and proceeds to Step S8. In Step S8, the control portion 19 turns on the first electromagnetic clutch CL1 by supplying the first electromagnetic clutch CL1 with electric power, thereby causing the first electromagnetic clutch CL1 to electromagnetically connect the gear shaft 38*s* of the first spur gear 38 with the gear shaft 31*s* of the first helical gear 31. Thus, the rotation of the first spur gear 38 is transmitted to the first helical gear 31. Thus, the first helical gear 31 is rotated in the direction indicated by an arrow mark by the rotation of the gear 40. Therefore, the first helical gear 31 moves the third helical gear 33 and the fixation roller 21 in the lengthwise direction of the fixation roller 21 from the front side of the fixing apparatus 15 to the rear side, as it does in Step S5. In Step S9, the control portion 19 turns off the second electromagnetic clutch CL2 by stopping the supply of the second electromagnetic clutch CL2 with electric power, whereby the second electromagnetic clutch CL2 is switched in state from the state in which it keeps connected the gear shaft 39*s* of the second spur gear 39 with the gear shaft 32*s* of the second helical gear 32, to the state in which the gear shafts 39*s* and 32*s* are kept not connected to each other. That is, in Step S9, the timing with which the second electromagnetic clutch CL2 is turned off is set in consideration of the length of time necessary to completely connect the gear shaft 38*s* of the first spur gear 38 with the gear shaft 31*s* of the first helical gear 31, and therefore, is such a timing that there will be a sufficient amount of time (several tens of seconds) for fully connecting the two shafts 38*s* and 31*s*. Further, the second electromagnetic clutch CL2 is turned off while the first electromagnetic clutch CL1 is kept turned on. Therefore, even if the second electromagnetic clutch CL2 is turned off, the fixation roller 21 is rotated by the rotational force transmitted from the gear 40 to the third helical gear 33 through the rotation force transmission route which does not include the second electromagnetic clutch CL2. Thus, it is ensured that the fixation roller 21 does not change in rotational speed. In Step S10, it is determined whether or not another print is to be outputted. If it is determined that another print is to be outputted (YES), the control portion 19 repeats the processes carried out in Step S4 to Step S9. That is, in a case where another print is to be outputted, the first electromagnetic clutch CL1 and second electromagnetic clutch CL2 are turned on or off in Steps S4-S9, while the recording medium P is conveyed through the nip N. As for the method, in this embodiment, for switching between the two electromagnetic clutches, one of the two electromagnetic clutches CL1 and CL2, which was kept turned off is turned on to turn on both electromagnetic clutches, and then, the other electromagnetic clutch, which was kept turned on is turned off. If it is determined that no print is to be outputted (NO), the operational sequence Steps S1-S9 is ended.

(When Photosensor PS2 is On)

In Step S11, the control portion 19 turns on the second electromagnetic clutch CL2 by supplying the second electromagnetic clutch CL2 with electric power, to cause the second electromagnetic clutch CL2 to electromagnetically connect the gear shaft 39*s* of the second spur gear 39 with the gear shaft 32*s* of the second helical gear 32, as it does in Step S5. That is, in Step S11, the second electromagnetic clutch CL2 is switched in state from the state in which it is off, to the state in which it is on. Thus, rotation of the second spur gear 39 is transmitted to the second helical gear 32. Thus, the second helical gear 32 is rotated in the direction indicated an arrow mark by the rotation of the gear 40. Therefore, the second helical gear 32 moves the fourth helical gear 34 and fixation roller 21 in the lengthwise direction of the fixation roller 21 from the rear side of the fixing apparatus 15 toward the front side. In Step S12, the motor M is started, whereby the gear 40 is rotated in the direction indicated by the arrow mark. Thus, the first spur gear 38 and the second spur gear 39 are rotated in the direction indicated by the arrow mark by the rotation of the gear 40. The first electromagnetic clutch CL1 is in the state in which it keeps the gear shaft 38*s* of the first spur gear 38 separated from the gear shaft 31*s* of the first helical gear 31. Therefore, the rotation of the first spur gear 38 is not transmitted to the first helical gear 31. On the other hand, the second electromagnetic clutch CL2 is in the state in which it keeps the gear shaft 39*s* of the second spur gear 39 connected to the gear shaft 32*s* of the second helical gear 32. Therefore, the rotation of the second spur gear 39 is transmitted to the second helical gear 32 through the second electromagnetic clutch CL2. In the case of the fixing apparatus 15 in this embodiment, the driving force transmission route to the third helical gear 33, and the driving force transmission route to the fourth helical gear 34, are structured so that the direction in which the fixation roller 21 is rotated when the first electromagnetic clutch is in action is the same as the direction in which the fixation roller 21 is rotated when the second electromagnetic clutch is in action. It is through the above-described driving force transmission routes that the second helical gear 32 is rotated in the direction indicated by the arrow mark by the rotation of the gear 40. That is, the second electromagnetic clutch CL2 transmits rotation of the gear 40 to the second helical gear 32. The second helical gear 32 rotates the fourth helical gear 34 and the fixation roller 21 in the direction indicated by the arrow mark (FIG. 2(*a*)). The rotation of the fixation roller 21 is transmitted to the peripheral surface of the pressure roller 22 by way of the nip N, whereby the pressure roller 22 is rotated in the direction indicated by the arrow mark by the rotation of the fixation roller 21 (FIG. 2(*a*)). As the second helical gear 32 rotates, it moves the fourth helical gear 34 and the fixation roller 21 in the lengthwise direction of the fixation roller 21 from the rear side of the fixing apparatus 15 to the front side, with the load F (thrust) which it generates in the axial direction of the fixation roller 21 in coordination with the fourth helical gear 34, and the amount of which is proportional to the helix angle of the two helical gears 32 and 34. That is, as the second helical gear 32 is rotated, the fourth helical gear 34 and the fixation roller 21 are moved frontward from the rear side of the fixing apparatus 15 by the abovementioned thrust F. In Step S13, it is determined whether or not the photosensor PS1 is on. If the photosensor PS1 detects the flag F1 (FIG. 3(*a*)), and the control portion 19 receives the flag detection signal from the photosensor PS1, and therefore, determines that the photosensor PS1 is on (YES), the control portion 19 proceeds to Step S14. In Step S14, the control portion 19 turns on the first electromagnetic clutch CL1 by supplying the first electromagnetic clutch CL1 with electric power, causing thereby the first electromagnetic clutch CL1 to electromagnetically connect the gear shaft 38*s* of the first spur gear 38 with the gear shaft 31*s* of the first helical gear 31. That is, in Step S14, the first electromagnetic clutch CL1 is switched in state from the state in which it is off, to the state in which it is on. Therefore, the rotation of the first spur gear 38 is transmitted to the first helical gear 31. Thus, the first helical gear 31 is rotated by the rotation of the gear 40 in the direction indicated by the arrow mark. As the first helical gear 31 is rotated, it moves the third helical gear 33 and the fixation roller 21 in the lengthwise direction of the fixation roller 21 from the front side of the fixing apparatus 15 toward the rear side. In Step S15, the control portion 19 turns off the second electromagnetic clutch CL2 by stopping the supply of the second electromagnetic clutch CL2 with electric power. Thus, the second electromagnetic clutch CL2 disengages the gear shaft 39*s* of the second spur gear 39 from the gear shaft 32*s* of the second helical gear 32, as it does in Step S9. That is, in Step S9, the second electromagnetic clutch CL2 is switched in state from the state in which it can transmit the rotational force, to the state in which it cannot transmit the rotational force, while the first electromagnetic clutch CL1 is on. In Step S15, the timing with which the second electromagnetic clutch CL2 is turned off is set in consideration of the length of time necessary to fully connect the gear shaft 38*s* of the first spur gear 38 with the gear shaft 31*s* of the first helical gear 31, and therefore, is such a timing that there will be a sufficient amount of time (several tens of seconds) for fully connecting the two shafts 38*s* and 31*s*. Further, the second electromagnetic clutch CL2 is turned off while the first electromagnetic clutch CL1 is kept turned on. Therefore, even if the second electromagnetic clutch CL2 is turned off, the rotational force is transmitted from the gear 40 to the third helical gear 33 through the rotation force transmission route which does not include the second electromagnetic clutch CL2. Therefore, it is ensured that the fixation roller 21 is continuously rotated, being prevented from changing in rotational speed. In Step S16, it is determined whether or not the photosensor PS2 is on. If the photosensor PS2 detects the flag F1 (FIG. 3(*b*)), and the control portion 19 receives the flag detection signal from the photosensor PS2, the control portion 19 determines that the photosensor PS2 is on (Yes), and proceeds to Step S17. In Step S17, the control portion 19 turns on the second electromagnetic clutch CL2 by supplying the second electromagnetic clutch CL2 with electric power, thereby causing the second electromagnetic clutch CL2 to electromagnetically connect the gear shaft 39*s* of the second spur gear 39 with the gear shaft 32*s* of the second helical gear 32, as it does in Step 11. Thus, the rotation of the second spur gear 39 is transmitted to the second helical gear 32. Thus, the second helical gear 32 is rotated in the direction indicated by the arrow mark by the rotation of the gear 40. Therefore, the second helical gear 32 moves the fourth helical gear 34 and the fixation roller 21 in the lengthwise direction of the fixation roller 21 from the rear side of the fixing apparatus 15 to the front side. In Step S18, the control portion 19 turns off the first electromagnetic clutch CL1 by stopping the supply of the first electromagnetic clutch CL1 with electric power, thereby causing the first electromagnetic clutch CL1 to disconnect the gear shaft 38*s* of the first spur gear 38 from the gear shaft 31*s* of the first helical gear 31 as it does in Step S6. That is, in Step S18, the first electromagnetic clutch CL1 is switched in state from the state in which it can transmit the rotational force, to the state in which it cannot transmit the rotational force, while the second electromagnetic clutch CL2 is kept on. The timing with which the first electromagnetic clutch CL1 is turned off in Step S18 is set in consideration of the length of time necessary to completely connect the gear shaft 39*s* of the second spur gear 39 with the gear shaft 32*s* of the second helical gear 32 in S17, and therefore, is such a timing that there will be a sufficient amount of time (several tens of seconds) for fully connecting the two shafts 39*s* and 32*s*. Further, the first electromagnetic clutch CL1 is turned off while the second electromagnetic clutch CL2 is kept turned on. Therefore, even if the first electromagnetic clutch CL1 is turned off, the rotational force is transmitted from the gear 40 to the fourth helical gear 34 through the rotation force transmission route which does not include the first electromagnetic clutch CL1, ensuring that the fixation roller 21 is rotated with no interruption, thereby preventing the fixation roller 21 from changing in rotational speed. In Step S19, it is determined whether or not another print is to be outputted. If it is determined that another print is to be outputted (YES), the control portion 19 repeats the processes carried out in Step S13 to Step S18. In a case where another print does not need to be outputted, the operational sequence Steps S11-S18 is ended. In a case where another print is to be outputted, the same processes as those carried out in Step S4 to S9, are carried out in Steps S13-S18. The method for switching the electromagnetic clutches in operational state is the same as the method used while prints are outputted in Step S1-S9. During the continuation of the sequential processes carried out in Steps S1-S9, the recording medium P on which the unfixed toner image t is present is introduced into the nip N while the fixation roller 21 and the pressure roller 22 are kept constant in temperature at a preset level, or during continuation of the sequential processes carried out in Steps S11-S18, the recording medium P, on which an unfixed toner image t is present, is introduced into the nip N while the fixation roller 21 and the pressure roller 22 are kept stable in surface temperature at a preset level. As the recording medium P is introduced into the nip N, it is conveyed through the nip N while remaining pinched between the peripheral surface of the fixation roller 21 and the peripheral surface of the pressure roller 22. While the recording medium P is conveyed through the nip N, the recording medium P and the unfixed toner image t are subjected to the heat and pressure from the fixation roller 21 and the pressure roller 22, whereby the unfixed toner image t is thermally fixed to the surface of the recording medium P.

The fixing apparatus 15 in this embodiment can rotate the fixation roller 21, and also, reciprocally move the fixation roller 21 in the lengthwise direction, with use of only a single motor (motor M). In other words, it is simple in structure, and yet, is substantially smaller in the amount by which certain portions of the peripheral surface of the fixation roller 21 are substantially more worn due to their contact with the thermistor and the recording medium separating claw, and also, the edges of the recording medium P, than the other portions. In other words, the present invention can simplify a fixing apparatus in structure, reduce a fixing apparatus in size, and also, in cost, as well as reduce electric power consumption. Further, in the case of the fixing apparatus 15 in this embodiment, the meshing of helical gears which are different in helix angle is utilized not only to rotate the fixation roller 21, but also, to reciprocally move the fixation roller 21 in the lengthwise direction. Therefore, it is possible to reciprocally and very gradually move the fixation roller 21 in the lengthwise direction while rotating the fixation roller 21. Therefore, the fixing apparatus 15 in this embodiment is significantly smaller than any of conventional fixing apparatuses of the same time, in the amount of the deformation which occurs to the peripheral surface of the fixation roller 21 in the nip N as the fixation roller 21 is reciprocally moved in the lengthwise direction while being rotated. Thus, even though the fixation roller 21 is reciprocally moved in the lengthwise direction while the recording medium P is continuously conveyed through the nip N, remaining pinched by the fixation roller 21 and the pressure roller 22, by switching the first electromagnetic clutch CL1 and the second electromagnetic clutch CL2 in operational state between the state in which the rotation of the motor M can be transmitted to the fixation roller 21, and the state in which the rotation of the motor M cannot be transmitted to the fixation roller 21, in such a manner that the rotation of the motor M is transmitted to the fixation roller 21 without interruption, the stress to which the recording medium P is subjected in the nip N is minuscule. Therefore, it is unlikely to occur that the recording medium P is wrinkled, and/or that the toner image t on the recording medium P is made to deviate in position.

Embodiment 2

Figure 6:
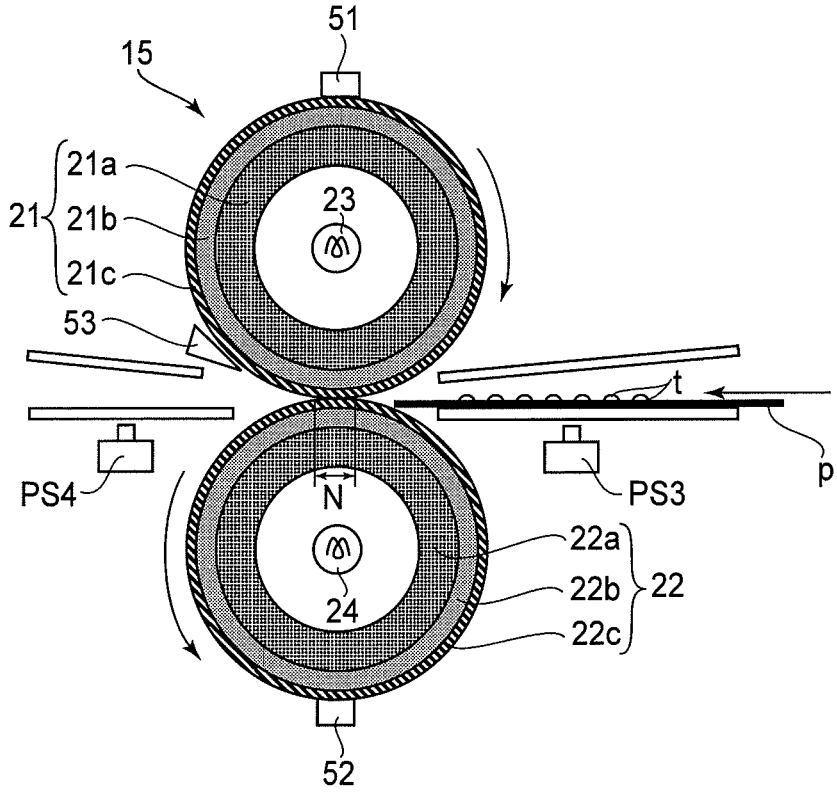
FIG. 6(*a*) is a schematic sectional view of the fixing apparatus in the second preferred embodiment of the present invention, and shows the structure of the apparatus.
Figure 6:
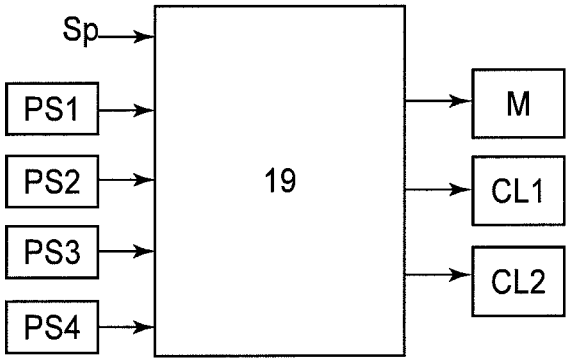

FIG. 6(*a*) is a schematic sectional view of the fixing apparatus in the second preferred embodiment of the present invention, and shows the structure of the apparatus. The members, portions, etc., of the fixing apparatus in the second embodiment, which are the same as their counterparts of the fixing apparatus 15 in the first embodiment, are given the same reference numerals and characters as those given to their counterparts and will not be described. In the case of the fixing apparatus 15 in the first embodiment, the first electromagnetic clutch CL1 and the second electromagnetic clutch CL2 are turned on or off while the recording medium P is conveyed through the nip N during a printing operation. Therefore, the fixation roller 21 sometimes slightly changes in rotation speed as the first electromagnetic clutch CL1 and the second electromagnetic clutch CL2 are turned on or off. The changes in the rotational speed of the fixation roller 21 sometimes results in the outputting of images which are non-uniform in appearance, in particular, when a highly precise multicolor image is formed on recording media of certain types. In the second embodiment, therefore, the fixing apparatus 15 is structured so that the first electromagnetic clutch CL1 and the second electromagnetic clutch CL2 are turned on or off while the recording medium P is not conveyed through the nip N. The fixing apparatus 15 in this embodiment is provided with a pair of photosensors PS3 and PS4, which are the third and fourth detecting members, respectively. The photosensor PS3 is on the recording medium entrance side of the nip N, which is between the peripheral surface of the fixation roller 21 and the peripheral surface of the pressure roller 22. The photosensor PS4 is on the recording medium exit side of the nip N. The fixing apparatus 15 in this embodiment is the same in structure as the fixing apparatus 15 in the first embodiment, except that in the case of the fixing apparatus 15 in this embodiment, the first electromagnetic clutch CL1 and the second electromagnetic clutch CL2 are turned on or off while the recording medium P is not where it can be detected by the photosensors PS3 and PS4. The photosensor PS3 is to detect the recording medium P on the upstream side of the nip N in terms of the recording-medium conveyance direction, and to output a recording-medium detection signal as it detects the recording medium P. The photosensor PS4 is to detect the recording medium P on the downstream side of the nip N in terms of the recording-medium conveyance direction, and to output a recording-medium detection signal as it detects the recording medium P. FIG. 6(*b*) is a block diagram of the hardware for controlling the operation of the fixation roller reciprocation mechanism of the fixing apparatus in the second embodiment of the present invention, and shows the structure of the hardware.

Figure 7:
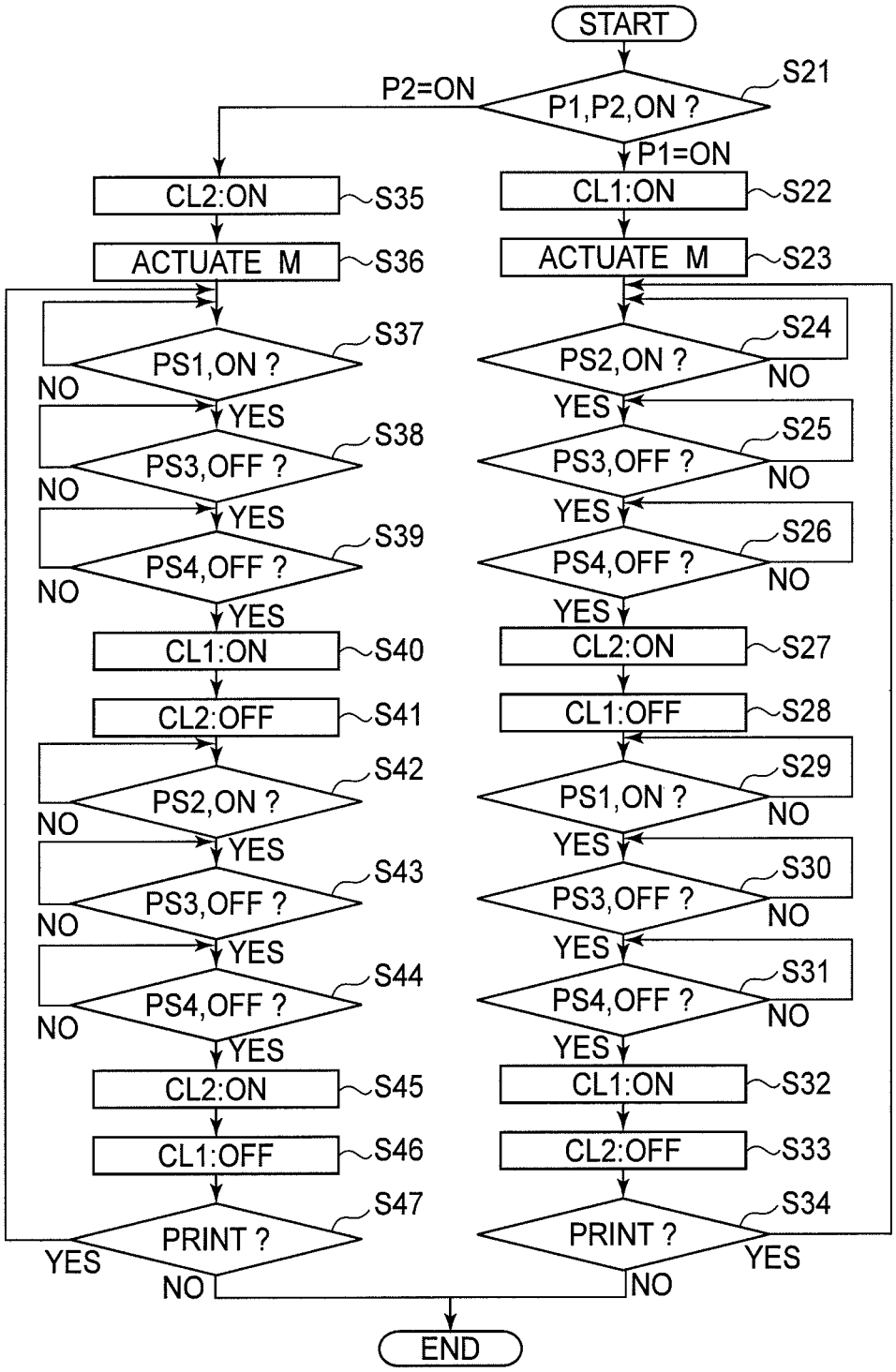
FIG. 7 is a flowchart of an example sequence for controlling the fixation roller reciprocation mechanism of the fixing apparatus in the second embodiment.

FIG. 7 is a flowchart of an example of the operation of the fixation-roller reciprocation mechanism of the fixing apparatus in the second embodiment. First, referring to FIG. 7, in Step S21, the same process as that carried out in Step S1 in FIG. 5 is carried out. That is, if the control portion 19 receives a recording-medium detection signal from the photosensor PS1, the control portion 19 proceeds to Step S22, whereas if the control portion 19 receives a recording-medium detection signal from the photosensor PS2, it proceeds to Step S35.

(Description of Fixing Apparatus Operation when Photosensor PS1 is On)

In Steps S22-S24, the control portion 19 carries out the same processes as those it carries out in Steps S1-S4 shown in FIG. 5. In Step S25, it determines whether or not the entrance photosensor PS3, which is on the entrance side of the nip N, is off. If it does not receives a recording-medium detection signal from the entrance photosensor PS3, it determines that the entrance photosensor PS3 is off (YES), and proceeds to Step S26, in which it determines whether or not the exit photosensor PS4, which is on the exit side of the nip N, is off. If it does not receive a recording-medium detection signal from the exit photosensor PS4, it determines that the exit photosensor PS4 is off (YES), and proceeds to Step S27. That is, if it does not receives a recording-medium detection signal from the entrance photosensor sensor PS3, and does not receive a recording medium detection signal from the exit photosensor PS4, it determines that there is no recording medium P in the nip N. In Steps S27-S29, it carries out the same processes as those it carries out in Step S5-S7 in FIG. 5. In Step S30, it determines whether or not the entrance photosensor PS3 is off. If it does not receives a recording-medium detection signal from the entrance photosensor PS3, it determines that the entrance photosensor PS3 is off (YES), and proceeds to S31, in which it determines whether or not the exit photosensor PS4 is off. If it does not receive a recording-medium detection signal from the exit photosensor PS4, it determines that the entrance photosensor PS4 is off (YES), and proceeds to Step S32. That is, only if it does not receives a recording-medium detection signal from entrance photosensor PS3 in Step S30, and a recording-medium detection signal from the exit photosensor PS4 in Step S31, it determines that there is no recording medium P in the nip N. In Steps S32-S33, it carries out the same processes as those which it does in Steps S8 and S9 shown in FIG. 5. In Step S34, it carries out the same process as the process it carries out in Step S10 shown in FIG. 5. That is, if it is necessary to output another print (YES), it repeats the same processes as those it carries out in Steps S24-S33. If it is unnecessary to output another print (NO), it ends the series of processes it carries out in Steps S21-S33. In a case where another print is necessary, the control portion 19 moves the fixation roller 21 in the lengthwise direction toward the rear side (or front side) of the fixing apparatus 15 in Steps S24-S33. Then, if it receives a flag detection signal from the photosensor PS1 (or PS2), it confirms whether or not the entrance photosensor PS3 is off. In a case where the photosensor PS1 (or PS2) is on, that is, while the recording medium P is conveyed through the nip N, the control portion 19 waits until the next recording medium P is introduced into the nip N, and then, it turns on or off the first electromagnetic clutch CL1 and the second electromagnetic clutch CL2. The length (several 100 ms) of time it takes for the recording medium P to be conveyed from the location of the entrance photosensor PS3 to the nip N is very small compared to the length of time it takes to turn on or off the first electromagnetic clutch CL1 (or second electromagnetic clutch CL2). Therefore, even if the fixing apparatus 15 is designed so that if the recording medium P is being conveyed through the nip N, the first and the second electromagnetic clutches CL1 and CL2 are not turned on or off until the next recording medium P is introduced into the nip N, there is no problem. Incidentally, if either the entrance photosensor PS3 or the exit photosensor PS4 is on, the control portion 19 determines that the recording medium P is being conveyed through the nip N. Further, the fixation roller 21 is moved from where it is when the photosensor PS1 (or PS2) is turned on to where it is when either entrance photosensor PS3 or exit photosensor PS4 is turned on. However, the lengthwise movement of the fixation roller 21 is no more than 0.5 mm/sec. In other words, the amount of the movement of the fixation roller 21 in the widthwise direction of the recording medium P per recording medium P is minute. Therefore, the problem that images which are nonuniform in appearance are outputted does not occur. Next, this subject will be described in detail. It is when the leading edge of the longest recording medium P in terms of the direction parallel to the recording-medium conveyance direction turns on the entrance photosensor PS3 that the length of time the control portion 19 has to wait before it turns on (or turns off) the electromagnetic clutches becomes longest. For example, if the longest recording medium P is 19 inches (=482.6 cm) in length; the distance between the entrance photosensor sensor PS3 and the exit photosensor PS4 is 100 mm, and the recording medium conveyance speed in the nip N is 500 mm/sec, the longest time the control portion 19 has to wait before it turns on (or off) the electromagnetic clutches is 1.16 seconds. If the maximum speed at which the fixation roller 21 is moved in the lengthwise direction is 0.5 mm/sec, the distance by which the fixation roller 21 overruns is 0.58 mm. This is only one example of the specification of a fixing apparatus. In any case, however, the amount of the overrun of the fixation roller 21 is minute. Thus, even if the conditions related to the operation of the image forming apparatus changes, there is no problem as long as the change is small. As for the switching between the first electromagnetic clutch CL1 and the second electromagnetic clutch CL2, the one which was off is turned on. Then, both electromagnetic clutches are turned on when the both the entrance photosensor PS3 and exit photosensor PS4 are off. Then, the electromagnetic clutch which was kept on is turned off.

(Operation of Fixing Apparatus when Photosensor PS2 is On)

In Step S35-S37, the control portion 19 carries out the same processes as those which it carries out in Step S11-S13 shown in FIG. 5. In Step S38, it determines whether or not the recording medium P has been detected by the entrance photosensor PS3 (whether the entrance photosensor PS3 is on or off). If the control portion 19 does not receive an indication that recording medium P has been detected by photosensor PS3 (YES), it proceeds to Step S39, in which it determines whether or not the exit photosensor PS4 has detected the recording medium P (whether the exit photosensor PS4 is on or off). If it determines that the exit photosensor PS4 has not detected the recording medium P (YES), it proceeds to Step S40. That is, if the control portion 19 does not receive a recording-medium detection signal from the entrance photosensor PS3 in Step 38, and also, from the exit photosensor PS4 in Step S39, the control portion 19 determines that there is no recording medium P in the nip N. In Steps S40-S42, the control portion 19 carries out the same processes as those it carries out in Step S14-S16 shown in FIG. 5. In Step S43, the control portion 19 determines whether or not the entrance photosensor PS3 has detected the recording medium P (whether or not the entrance photosensor PS3 is on or off). If the control portion 19 does not receives the recording medium detection signal from the entrance photosensor PS3 (YES), it proceeds to Step S44, in which it determines whether or not the exit photosensor PS4 has detected the recording medium P. If it does not receives a recording-medium detection signal from the exit photosensor PS4 (YES), it proceeds to Step S45. That is, if the control portion 19 does not receive a recording-medium detection signal from the entrance photosensor PS3 in Steps S43, and from the exit photosensor PS4 in Step S44, it determines that there is no recording medium P in the nip N. In Steps S45 and S46, it carries out the same processes as those it carries out in Steps S17 and S18 shown in FIG. 5. In Step S47, it carries out the same process as the process it carries out in Step 19 shown in FIG. 5. That is, if it is necessary to output another print (YES), it carries out the same processes as those it carries out in Steps S37-S46. If it is unnecessary to output another print (NO), it ends the sequence of processes carried out in Steps S35-S46. If another print is to be outputted (YES), the control portion 19 carries out the same processes as those it carries out in Steps S24-S33. As for the method in which the electromagnetic clutches are sequentially turned on or off, or in combination, it is the same as that in which they are in Steps S24-33.

Also in the case of the fixing apparatus 15 in the second embodiment, only a single motor (motor M) is required to reciprocally move the fixation roller 21 in the lengthwise direction while rotating the fixation roller 21. Thus, the same effects as those achieved by the fixing apparatus 15 in the first embodiment were achieved. In this embodiment, however, the first electromagnetic clutch and the second electromagnetic clutch are turned on or off when both the entrance photosensor and exit photosensor are off, that is, while no recording medium P is conveyed through the nip N. Therefore, it does not occur that images which are nonuniform in appearance, and the nonuniformity of which is attributable to the change in the rotational speed of the fixation roller, are outputted. In other words, the fixing apparatus 15 in this embodiment can also prevent an image forming apparatus from outputting images which are nonuniform in appearance, including images, the nonuniformity of which is ordinarily nonproblematic. Further, in the case of the fixing apparatus 15 in this embodiment, the first electromagnetic clutch is turned on or off with a different timing from the timing with which the second electromagnetic clutch is turned on or off. However, the first electromagnetic clutch and the second electromagnetic clutch may be turned on or off at the same time.

Embodiment 3

Figure 8:
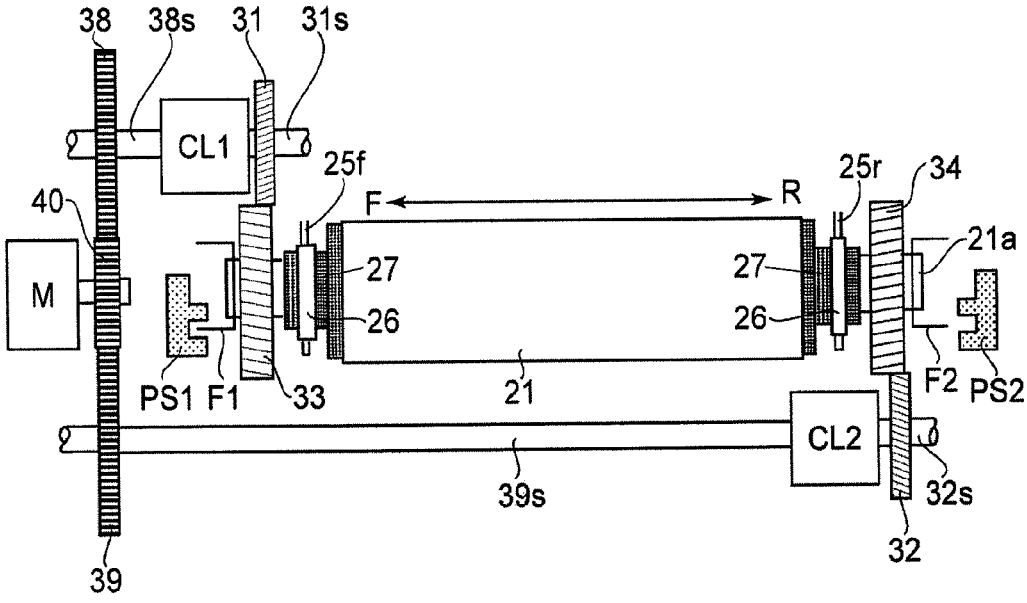
FIG. 8 is a schematic drawing of the fixing apparatus in the third embodiment of the present invention, and depicts the structure of another example of the fixation roller reciprocation mechanism.

FIG. 8 is a schematic drawing of the fixing apparatus in the third embodiment of the present invention, and depicts the structure of another example of the fixation-roller reciprocation mechanism. Also in the case of the fixing apparatus 15 in this embodiment, the members, portions, etc., of the fixing apparatus 15, which are the same as their counterparts of the fixing apparatus 15 in the first embodiment, are given the same reference numerals and characters as those given to their counterparts, and will not be described. In the case of the fixing apparatus 15 in the first embodiment, the third and fourth helical gears 33 and 34, respectively, are solidly attached to the lengthwise end portion of the metallic core 21*a* of the fixation roller 21, which is on the front side of the first top frame 25*f*. In the case of the fixing apparatus 15 in this (third) embodiment, the third helical gear 33 is solidly attached to one of lengthwise end portions, more specifically, the front end portion, of the metallic core 21*a* of the fixation roller 21, and the fourth helical gear 34 is solidly attached to the other lengthwise end portion, more specifically, the rear end portion, of the metallic core 21*a* of the fixation roller 21. Otherwise, the fixing apparatus 15 in this embodiment is the same in structure as the fixing apparatus 15 in the first embodiment. That is, the reciprocation mechanism of the fixing apparatus 15 in this embodiment is different from that of the fixing apparatus 15 in the first embodiment, only in the positioning of the third and fourth helical gears 33 and 34, respectively. Thus, the effects of the fixing apparatus 15 in this embodiment are the same as those of the fixing apparatus 15 in the first embodiment.

As will be evident from the description of the preferred embodiments of the present invention, the present invention makes it possible to provide an image heating apparatus which is simple in the structural arrangement for reciprocating the rotational heating member of the apparatus in the lengthwise direction of the rotational heating member while rotating the rotational heating member, in order to minimize the amount by which the peripheral surface of the rotational heating member is frictionally worn.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 205782/2009 filed Sep. 7, 2009 which is hereby incorporated by reference.

What is claimed is:

1. An image heating apparatus comprising:

a heating rotatable member configured to heat an image on a recording material;

a pressing rotatable member configured to contact said heating rotatable member to form a nip therebetween;

a driving source;

a driving gear provided on a shaft of said driving source;

a first helical gear rotatable by the driving force supplied from said driving source;

a second helical gear rotatable by the driving force supplied from said driving source, said second helical gear having a twisting direction which is different from that of said first helical gear;

a first switching member configured to switch between rotation transmission and non-transmission states from said driving gear to said first helical gear;

a second switching member configured to switch between rotation transmission and non-transmission states from said driving gear to said second helical gear;

a third helical gear provided on said heating rotatable member in meshing engagement with said first helical gear;

a fourth helical gear provided on said heating rotatable member in meshing engagement with said second helical gear; and switching means for switching at least between drive transmission by said first switching member and drive transmission by said second switching member to change a position of said heating rotatable member along a rotational axis direction of said heating rotatable member.

2. The apparatus according to claim 1, further comprising a first detecting member and a second detecting member, wherein when said first detecting member detects that said heating rotatable member is displaced toward one longitudinal end portion of said heating rotatable member, said switching means switches said first switching member from the rotation transmission state to the non-transmission state, and when said second detecting member detects that said heating rotatable member is displaced toward the other longitudinal end portion of said heating rotatable member, said switching means switches said second switching member to the non-transmission state.

3. The apparatus according to claim 2, wherein said switching means switches said first switching member from the rotation transmission state to the non-transmission state during the time when said second switching member is in the rotation transmission state, and switches said second switching member from the rotation transmission state to the non-transmission state during the time the first switching member is in the rotation transmission state.

4. The apparatus according to claim 2, wherein said switching means effects switching of said first switching member from the rotation transmission state to the non-transmission state simultaneously with switching of said second switching member from the non-transmission state to the rotation transmission state, and said switching means effects switching of said second switching member from the rotation transmission state to the non-transmission state simultaneously with switching of said first switching member from the non-transmission state to the rotation transmission state.

5. The apparatus according to claim 1, wherein said switching means effects the switching of said first switching member between the rotation transmission state and the non-transmission state and the switching of said second switching member between the rotation transmission state and the non-transmission state, during feeding of the recording material through said nip.

6. The apparatus according to claim 1, wherein said switching means effects the switching of said first switching member between the rotation transmission state and the non-transmission state and the switching of said second switching member between the rotation transmission state and the non-transmission state, during non-feeding of the recording material through said nip.

7. The apparatus according to claim 1, wherein a direction of rotation of said heating rotatable member by transmission of the driving force from said first switching member and a direction of rotation of heating rotatable member by transmission of the driving force from said second switching member are the same.

8. An image heating apparatus comprising:

a heating roller configured to heat an image on a recording material;

a driving source;

a first helical gear rotatable by a driving force supplied from said driving source;

a second helical gear rotatable by a driving force supplied from said driving source;

a first clutch mechanism configured to switch between a state in which the driving force is supplied to said first helical gear and a state in which the driving force is not supplied to said first helical gear;

a second clutch mechanism configured to switch between a state in which the driving force is supplied to said second helical gear and a state in which the driving force is not supplied to said second helical gear;

a third helical gear co-axially provided on said heating roller in meshing engagement with said first helical gear;

a fourth helical gear co-axially provided on said heating roller in meshing engagement with said second helical gear, said fourth helical gear having a twisting direction which is opposite to that of said third helical gear; and a controller configured to control said first clutch mechanism and said second clutch mechanism to displace said heating roller in an axial direction of said heating roller by selecting one of a drive transmitting path via said third helical gear and a drive transmitting path via said fourth helical gear.

9. The apparatus according to claim 8, wherein said controller alternately selects the drive transmitting path via said third helical gear and the drive transmitting path via said fourth helical gear to change a position of said heating roller in the axial direction.

10. The apparatus according to claim 9, wherein when the drive transmitting path via said third helical gear is selected, said controller controls said first clutch mechanism to establish the state in which the driving force is transmitted from said driving gear to said first helical gear and controls said second clutch mechanism to establish the state in which the driving force is not transmitted from said driving gear to said second helical gear, and when the drive transmitting path via said fourth helical gear is selected, said controller controls said first clutch mechanism to establish the state in which the driving force is not transmitted from said driving gear to said first helical gear and controls said second clutch mechanism to establish the state in which the driving force is transmitted from said driving gear to said second helical gear.

11. The apparatus according to claim 8, wherein when the drive transmitting path via said third helical gear is selected, said controller controls said first clutch mechanism to establish the state in which the driving force is transmitted from said driving gear to said first helical gear and controls said second clutch mechanism to establish the state in which the driving force is not transmitted from said driving gear to said second helical gear, and when the drive transmitting path via said fourth helical gear is selected, said controller controls said first clutch mechanism to establish the state in which the driving force is not transmitted from said driving gear to said first helical gear and controls said second clutch mechanism to establish the state in which the driving force is transmitted from said driving gear to said second helical gear.

12. The apparatus according to claim 8, wherein a direction of rotation of said heating roller by the driving force received through the drive transmitting path via said third helical gear and a direction of rotation of said heating roller by the driving force received through the drive transmitting path via said fourth helical gear are the same.

13. The apparatus according to claim 8, further comprising a gear provided between said driving source and said first clutch mechanism and configured to transmit the driving force to said first helical gear, and a gear provided between said driving source and said second clutch mechanism and configured to transmit the driving force to said second helical gear.

14. The apparatus according to claim 8, further comprising a first detector and a second detector, wherein when said first detector detects that said heating roller is displaced toward one end portion of said apparatus in the axial direction, said controller selects the drive transmitting path via said third helical gear, and when said second detector detects that said heating roller is displaced toward the other end portion of said apparatus in the axial direction, said controller selects the drive transmitting path via said fourth helical gear.

15. An image heating apparatus comprising:

a heating rotatable member configured to heat an image on a recording material;

a pressing rotatable member configured to contact said heating rotatable member to form a nip therebetween;

a driving source;

a driving gear provided on a shaft of said driving source;

a first helical gear rotatable by the driving force supplied from said driving source;

a second helical gear rotatable by the driving force supplied from said driving source, said second helical gear having a twisting direction which is different from that of said first helical gear;

a first switching member configured to switch between rotation transmission and non-transmission states from said driving gear to said first helical gear;

a second switching member configured to switch between rotation transmission and non-transmission states from the driving gear to said second helical gear;

a third helical gear provided on said heating rotatable member in meshing engagement with said first helical gear;

a fourth helical gear provided on said heating rotatable member in meshing engagement with said second helical gear; and a processor configured to switch at least between drive transmission by said first switching member and drive transmission by said second switching member to change a position of said heating rotatable member along a rotational axis direction of said heating rotatable member.

* * * * *